US005797808A

United States Patent [19]

Hayashi et al.

[11] Patent Number: 5,797,808

[45] Date of Patent: Aug. 25, 1998

[54] WOUND GOLF BALL

[75] Inventors: Junji Hayashi; Hisashi Yamagishi, both of Chichibu, Japan

[73] Assignee: Bridgestone Sports Co., Ltd., Tokyo, Japan

[21] Appl. No.: 831,515

[22] Filed: Apr. 1, 1997

[30] Foreign Application Priority Data

Apr. 3, 1996 [JP] Japan ..... 8-106316

[51] Int. Cl.[6] ..... A63B 37/06; A63B 37/12

[52] U.S. Cl. ..... 473/364; 473/365

[58] Field of Search ..... 473/357, 359, 473/361, 362, 363, 364, 365, 373, 376, 378, 366

[56] References Cited

U.S. PATENT DOCUMENTS 5,542,663 8/1996 Kato et al. ..... 473/363

5,674,137 10/1997 Maruko et al. ..... 473/378 X 5,688,191 11/1997 Cavallaro et al. ..... 473/373

*Primary Examiner*—George J. Marlo

*Attorney, Agent, or Firm*—Sughrue, Mion, Zinn, Macpeak & Seas, PLLC

[57] ABSTRACT

A wound golf ball is constructed by winding thread rubber on a center ball and enclosing with a cover. The center ball consists of a center core having a diameter of 27–37 mm and experiencing a distortion of 3.5–10 mm under a load of 100 kg and an enclosure layer having a Shore D hardness of 55–68 and has a diameter of 33–38 mm. The cover consists of an inner layer having a Shore D hardness of 55–68 and an outer layer having a Shore D hardness of 30–58, the inner layer being harder than the outer layer by at least 5 in Shore D hardness. The ball is improved in spin, control and flight distance at any head speed from high to low ranges so that players may favorably use it independent of their skill or head speed.

2 Claims, 1 Drawing Sheet

WOUND GOLF BALL

BACKGROUND OF THE INVENTION

1. Field of the Invention

This invention relates to a wound golf ball which is improved in spin, control, flight performance, and hitting feel so that even golf players with low head speeds may favorably use it.

2. Prior Art

As compared with two- and multi-piece solid golf balls having a solid core enclosed with one or more covers, wound golf balls are superior in hitting feel and controllability, but inferior in flight distance upon driver shots because of an increased spin rate.

In order to increase the flight distance of wound golf balls upon driver shots, attempts were made to suppress a spin rate as disclosed in JP-A 129072/1984 and 4104/1994. One exemplary wound golf ball has a center ball with a relatively large diameter.

The wound golf balls having a large diameter center ball are intended to increase the flight distance upon driver shots by suppressing a spin rate. However, since the center ball is relatively large, the hardness of the center ball has substantial influence on ball performance. The hitting feel becomes hard or soft depending on whether the center ball is hard or soft. Additionally, a satisfactory flight distance is not always obtainable from the soft center ball since restitution is somewhat lost.

Furthermore, most of the above-mentioned proposals target golfers who swing at high head speeds, that is, average to advanced players. Thus players who swing at high head speeds can take advantage of these balls. However, when players who swing at low head speeds, such as beginner, female and senior players use the same golf balls, they can not always obtain the advantage of increased flight distance. There is a need to solve these problems.

SUMMARY OF THE INVENTION

An object of the present invention is to provide a wound golf ball which is improved in spin, control, flight, and feel. Another object of the present invention is to provide a wound golf ball which even golf players with low head speeds can favorably use and which targets golf players of different skill encompassing from beginners to professionals.

Regarding a wound golf ball comprising a center ball having thread rubber wound thereon and a cover enclosing the wound center ball, we have found that by constructing a relatively large diameter center ball of the two layer structure consisting of a center core and an enclosure layer, constructing a cover of the two layer structure consisting of an inner layer and an outer layer, and adjusting the hardness of the respective layers so as to provide the ball with an optimum overall hardness distribution, the ball is improved in control and flight performance and given a soft pleasant hitting feel.

According to the invention, the center core is formed relatively soft so as to undergo a distortion of 3.5 to 10 mm under a constant load of 100 kg and to an outer diameter of up to 37 mm, the enclosure layer is formed relatively hard so as to have a Shore D hardness of at least 55, the center ball consisting of the center core and the enclosure layer is formed to a relatively large diameter of 33 to 38 mm, the cover inner layer is formed relatively hard so as to have a Shore D hardness of 55 to 68, the cover outer layer is formed relatively soft so as to have a Shore D hardness of 30 to 58, and the cover inner layer is formed harder than the cover outer layer by at least 5 in Shore D hardness. Then the relatively soft center core contributes to a soft hitting feel and serves to reduce spin and accordingly extend flight distance upon driver shots. The relatively hard enclosure layer improves the restitution of the ball. The relatively large diameter center ball consisting of the center core and the enclosure layer is effective for suppressing a spin rate, achieving an increase of flight distance. Additionally, the relatively soft cover outer layer contributes to an improvement in control while the relatively hard cover inner layer contributes to an improvement in restitution. These functions and results are effectively achieved in good balance by setting the hardness of the center core, enclosure layer, cover outer layer and cover inner layer as defined above.

Examining if the performance of a golf ball constructed as above varies with head speeds, we have found that not only average to low-handicap players with relatively high swing speeds, but also those players with low swing speeds and hence, low head speeds such as beginner, female, and senior players can equally take advantage of the ball. Differently stated, the wound golf ball of the above construction need not target only average to low-handicap players, but is adequate for all players with different levels of skill. The present invention is predicated on these findings.

Therefore, the present invention provides a wound golf ball comprising a center ball having thread rubber wound thereon and a cover enclosing the wound center ball. The center ball consists of a center core having a diameter of up to 37 mm and experiencing a distortion of 3.5 to 10 mm under a constant load of 100 kg and a layer enclosing the center core and having a Shore D hardness of at least 55. The center ball has a diameter of 33 to 38 mm. The cover consists of an inner layer having a Shore D hardness of 55 to 68 and an outer layer having a Shore D hardness of 30 to 58. The cover inner layer is harder than the cover outer layer by at least 5 in Shore D hardness.

BRIEF DESCRIPTION OF THE DRAWINGS

These and further features of the present invention will be apparent with reference to the following description and drawings.

The only figure.

DETAILED DESCRIPTION OF THE INVENTION

Figure 1:
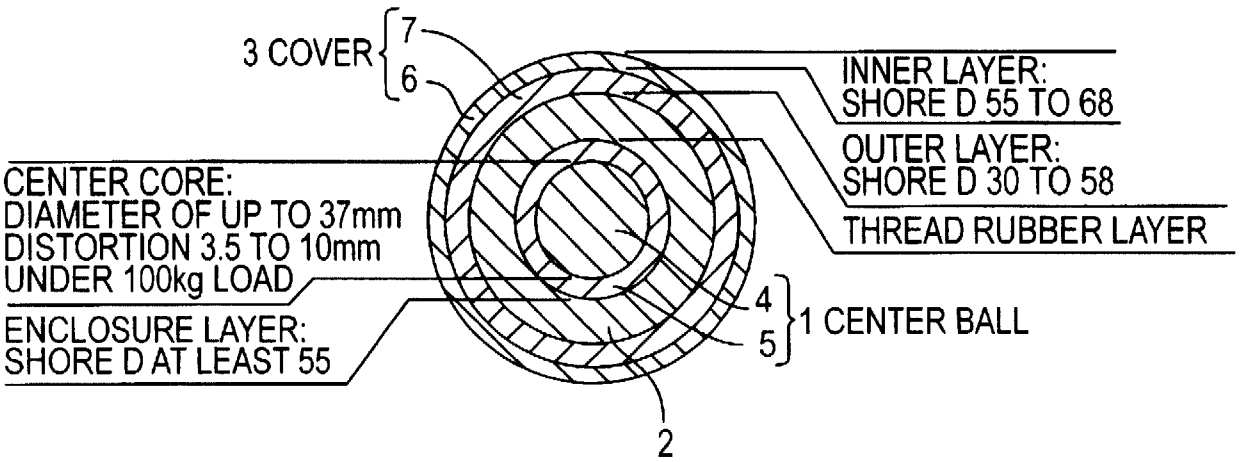
FIG. 1 is a schematic cross-sectional view of a wound golf ball according to one embodiment of the invention.

Referring to FIG. 1, a wound golf ball according to the invention is illustrated as comprising a center ball 1, a thread rubber layer 2 formed by winding thread rubber around the center ball, and a cover 3 enclosing the thread rubber layer 2. According to the invention, the center ball 1 is constructed as a two layer structure consisting of a center core 4 and an enclosure layer 5, and the cover 3 is constructed as a two layer structure consisting of an outer layer 6 and an inner layer 7.

In order to provide a soft hitting feel, a controlled spin rate enough to increase a flight distance, and good rebound in a low head speed range, the center core 4 constituting the center ball 1 is formed relatively soft so that its distortion is 3.5 to 10 mm, preferably 4.5 to 9 mm under a fixed load of 100 kg, and to an outer diameter of up to 37 mm, preferably 27 to 36 mm. A center core distortion in excess of 10 mm under a load of 100 kg results in too soft hitting feel and a loss of restitution. With a distortion of less than 3.5 mm, the resultant hitting feel is hard and unpleasant, and the rebound in a low head speed range is lost. An outer diameter in excess of 37 mm inevitably requires the thread rubber layer 2 to be thin with a resultant loss of resilience.

The center core can be produced by a well-known method, for example, by heat compression molding of a conventional rubber composition comprising base rubber, a co-crosslinking agent, and a peroxide.

More particularly, the base rubber used herein may be polybutadiene rubber or a mixture of polybutadiene rubber and polyisoprene rubber as used in conventional solid centers although 1,4-polybutadiene having at least 90% of cis-structure is preferred, especially for high restitution. The co-crosslinking agent which can be used herein include zinc and magnesium salts of unsaturated fatty acids such as acrylic acid and methacrylic acid and ester compounds such as trimethylpropane trimethacrylate as used in the prior art. Zinc acrylate is preferred because high resilience is expectable. The amount of the co-crosslinking agent blended is preferably 10 to 30 parts by weight per 100 parts by weight of the base rubber. Various peroxides are useful although dicumyl peroxide or a mixture of dicumyl peroxide and 1,1-bis(t-butylperoxy)-3,3,5-trimethylcyclohexane are preferred. The amount of the peroxide blended is preferably 0.5 to 1.5 parts by weight per 100 parts by weight of the base rubber.

If desired, zinc oxide or barium sulfate may be blended in the rubber composition for adjusting the specific gravity. Blending of other additives such as anti-oxidants is acceptable. Since a center core is generally frozen in order to prevent the center core from deforming upon winding of thread rubber, oily substance is often added to the center core for facilitating freezing. The oily substance added, however, can reduce restitution and adversely affect the temperature dependency of restitution. In the practice of the invention, it is thus recommended to omit such oily substance.

The center ball 1 of the wound golf ball according to the invention is constructed by surrounding the center core 4 with the enclosure layer 5.

The enclosure layer 5 is formed on the spherical surface of the center core having a relatively low hardness. The enclosure layer 5 is a relatively hard layer having a Shore D hardness of at least 55, preferably 58 to 68. It serves to impart rebound to the golf ball without altering the hitting feel and spin performance provided by the center core. If the Shore D hardness of the enclosure layer is less than 55, the center ball as a whole becomes too soft, with a restitution decline. The gage of the enclosure layer 5 is generally 0.5 to 5 mm, especially 1 to 3 mm although it may be appropriately selected in accordance with the hardness of the enclosure layer itself and the outer diameter of the center core 4. An enclosure layer having a gage of more than 5 mm naturally requires the center core to be reduced in diameter, with a possibility of losing soft feel and less spin. An enclosure layer having a gage of less than 0.5 mm would not exert its own function and can reduce restitution.

The enclosure layer 5 may be formed by injection molding a well-known thermoplastic resin around the center core 4. Any thermoplastic resin may be used insofar as it cures into a layer having a hardness in the above-defined range. For example, ionomer resins, polyester elastomers, and polyamide elastomers are preferably used. Illustrative examples include ionomer resins such as Himilan 1605, 1706, AM7317, 1601, 1557, and 1855 (trade name, manufactured by Mitsui-duPont Polychemical K.K.) and Surlyn 8940, 9910, 8527, and 9020 (trade name, manufactured by E. I. duPont), polyester elastomers such as Hytrel 5557 and 6347 (trade name, manufactured by Toray-duPont K.K.), and polyamide elastomers such as Pebax 5533 and 6312 (trade name, manufactured by Toray K.K.). Particularly when the cover is formed by heat pressure molding which will be described later, the heat can cause the enclosure layer to melt to lose resilience. It is then recommended for the enclosure layer to use a resin having a higher melting point than the heating temperature.

The center ball 1 having the center core 4 enclosed with the enclosure layer 5 should have an outer diameter of 33 to 38 mm, preferably 34 to 37 mm in order to appropriately reduce a spin rate to increase a flight distance. A center ball having an outer diameter of more than 38 mm naturally requires the resilient thread rubber layer 2 to be thin, inviting a reduction of flight distance. A center ball having an outer diameter of less than 33 mm is ineffective for reducing spin susceptibility, failing to prevent sharp rise and flight shortage.

Next, the cover 3 of the wound golf ball according to the invention is formed as a two layer structure consisting of the radially outer layer 6 and the radially inner layer 7. The respective layers 6 and 7 may be formed of a composition comprising a base resin well known as a cover stock, for example, ionomer resins, polyurethane elastomers, and balata rubber and optionally, commonly used amounts of a pigment such as titanium white and a dispersant such as magnesium stearate. The outer layer is formed to a low hardness and the inner layer is formed to a higher hardness than the outer layer.

More specifically, the cover outer layer 6 is formed as a relatively soft layer having a Shore D hardness of 30 to 58, preferably 35 to 55, thereby increasing a spin rate on approach shots to improve controllability. The cover outer layer 6 may be formed of any desired material insofar as the above-defined hardness is obtained. For example, ionomer resins such as Himilan 8120, 8220 and 8320 (Mitsui-duPont Polychemical K.K.) and a mixture thereof, polyurethane elastomers such as Pandex (Dai-Nihon Ink Chemical Industry K.K.), and balata rubber may be used.

Although the gage of the outer layer is not particularly limited, it is preferably 0.5 to 2 mm, especially 0.7 to 1.5 mm. An outer layer of thinner than 0.5 mm would be ineffective for improving controllability whereas a cover having an outer cover of thicker than 2 mm becomes too soft as a whole, probably inviting a restitution decline.

The cover inner layer 7 is formed as a relatively hard layer having a Shore D hardness of 55 to 68, preferably 60 to 66, thereby ensuring sufficient restitution. Any desired resin may be used insofar as it cures into a layer having a hardness in the above-defined range. Illustrative examples include ionomer resins such as Himilan 1554, 1555, 1601, 1702, 1705, and 1706 (trade name, manufactured by Mitsui-duPont Polychemical K.K.) and mixtures thereof as well as polyurethane elastomers such as Pandex (trade name, manufactured by Dai-Nihon Ink Chemical Industry K.K.).

Although the gage of the inner layer is not particularly limited, it is preferably 0.5 to 2 mm, especially 0.7 to 1.5 mm. An inner layer of thinner than 0.5 mm would be ineffective for providing sufficient restitution with a decline of flight distance. A cover having an inner cover of thicker than 2 mm becomes too hard as a whole, probably leading to less controllability and poor hitting feel.

The hardness difference between the inner layer and the outer layer of the cover should be at least 5, especially at least 10 in Shore D hardness. With a hardness difference of less than 5, it would become difficult for the outer and inner layers to individually exert their own functions.

As mentioned above, the cover 3 of the golf ball according to the invention is of the two layer structure consisting of the outer and inner layers 6 and 7 wherein the outer layer cooperates with the inner layer to ensure satisfactory rebound. Especially on approach shots, the outer layer cooperates with the inner layer to produce optimum spin, offering the advantage of ease of control. Although the total gage of the cover 3 is not particularly limited, it is preferably 1 to 3.5 mm, especially 1.5 to 3 mm.

It is now briefly described how to prepare the golf ball of the present invention basically comprising the center ball 1, the thread rubber layer 2, and the cover 3. When thread rubber is wound around the center ball 1 to form the thread rubber layer 2 thereon to construct a wound core, thread rubber of a known type and a well-known winding method may be used. The thread rubber layer 2 preferably has a gage of 1 to 4 mm, especially 1.5 to 3.8 mm. The wound core composed of the center ball 1 and the thread rubber layer 2 is then enclosed with the cover 3 of two layer structure by well-known processes, for example, by repeating twice the step of directly injection molding a cover stock on the wound core. Alternatively, the cover may be applied by preforming hemispherical half cups from cover stocks, lapping two pairs of half cups, encasing the wound core in the half cups, and effecting heat pressure molding at 110° to 160° C. for 2 to 10 minutes.

The wound golf ball of the invention may be formed in its cover surface with dimples in a conventional pattern by a well-known method. The ball should have a diameter of not less than 42.67 mm and a weight of not greater than 45.93 grams in accordance with the Rules of Golf.

EXAMPLE

Examples of the present invention are given below together with Comparative Examples by way of illustration and not by way of limitation.

Examples 1–7 and Comparative Examples 1–4

A center ball was prepared by milling a rubber composition of the formulation shown in Table 1 in a roll mill and pressure molding it at 155° C. for 15 minutes to form a center core. An ionomer resin as shown in Table 1 was then injection molded around the center core to form an enclosure layer on the surface of the center core, completing the center ball.

Thread rubber was wound around the center ball by a conventional winding method to produce a wound core having an outer diameter of about 39.7 mm.

A cover stock was prepared by milling 100 parts by weight of a resin as shown in Table 1, 5 parts by weight of titanium white, and 0.3 part by weight of magnesium stearate in a twin-screw extruder. Half cups were formed from the cover stock by injection molding. The wound core was then encased in two pairs of lapped half cups which were subject to compression molding to form a two-layer cover, obtaining a wound golf ball. Note that in Comparative Examples 1 to 3, only a pair of half cups were used to form a single layer cover.

The thus produced golf balls were examined for flight and hitting feel.

The balls were actually hit with a driver (#W1) at a head speed of 45 m/sec. and 35 m/sec. to measure a spin rate, carry, and total distance. The balls were actually hit with a sand wedge (SW) at a head speed of 20 m/sec. to measure a spin rate.

The balls were also examined for hitting feel by a panel of three professional golfers with a head speed of about 45 m/sec. and three top class amateur women golfers with a head speed of about 35 m/sec. who actually hit the balls. The ball was rated "⊙" for very soft feel, "O" for soft feel, "Δ" for rather hard feel, and "X" for hard feel.

The results are shown in Table 2.

TABLE 1

| | | E1 | E2 | E3 | E4 | E5 | E6 | CE1 | CE2 | CE3 | CE4 |
|---|---|---|---|---|---|---|---|---|---|---|---|
| Core | Cis-1,4-polybutadiene | 100 | 100 | 100 | 100 | 100 | 100 | 100 | 100 | 100 | 100 |
| | Zinc acrylate | 20 | 22 | 18 | 25 | 11 | 20 | 32.5 | 18 | 11.5 | 11.5 |
| | Dicumyl peroxide | 1.2 | 1.2 | 1.2 | 1.2 | 1.2 | 1.2 | 1.2 | 1.2 | 1.2 | 1.2 |
| | Antioxidant | 0.2 | 0.2 | 0.2 | 0.2 | 0.2 | 0.2 | 0.2 | 0.2 | 0.2 | 0.2 |
| | Zinc oxide | 5 | 5 | 5 | 5 | 5 | 5 | 5 | 5 | 5 | 5 |
| | Barium sulfate | 61.5 | 61.0 | 62.0 | 33.0 | 123.5 | 61.5 | 34.0 | 39.5 | 105.5 | 105.5 |
| Enclosure layer | Himilan 1605 | 50 | 50 | — | 50 | — | 50 | — | — | — | — |
| | Himilan 1706 | 50 | — | — | 50 | — | 50 | — | — | — | — |
| | Himilan AM7317 | — | — | 50 | — | — | — | — | — | — | — |
| | Himilan AM7318 | — | — | 50 | — | — | — | — | — | — | — |
| | Himilan 1601 | — | — | — | — | 50 | — | — | — | — | — |
| | Himilan 1557 | — | — | — | — | 50 | — | — | — | — | — |
| | Himilan 1855 | — | 50 | — | — | — | — | — | — | — | — |
| Cover outer layer | Surlyn 8120 | 35 | 35 | 35 | 35 | 35 | 100 | 35 | 35 | — | 35 |
| | Himilan 1650 | 65 | 65 | 65 | 65 | 65 | — | 65 | 65 | — | 65 |
| | Himilan 1601 | — | — | — | — | — | — | — | — | 50 | — |
| | Himilan 1557 | — | — | — | — | — | — | — | — | 50 | — |
| Cover inner layer | Himilan 1601 | 50 | 50 | 50 | 50 | 50 | 50 | — | — | — | 50 |
| | Himilan 1557 | 50 | 50 | 50 | 50 | 50 | 50 | — | — | — | 50 |

Note: Surlyn is a trade name of ionomer resins by E. I. duPont, and Himilan is a trade name of ionomer resins by Mitsui-duPont Polychemical K. K.

TABLE 2

| | | E1 | E2 | E3 | E4 | E5 | E6 | CE1 | CE2 | CE3 | CE4 |
|---|---|---|---|---|---|---|---|---|---|---|---|
| Center construction | | 2 layers | 2 layers | 2 layers | 2 layers | 2 layers | 2 layers | 1 layer | 1 layer | 1 layer | 1 layer |
| Cover construction | | 2 layers | 2 layers | 2 layers | 2 layers | 2 layers | 2 layers | 1 layer | 1 layer | 1 layer | 2 layers |
| Core | diameter (mm) | 32.0 | 32.0 | 32.0 | 35.5 | 27.0 | 32.0 | 36.0 | 36.0 | 27.6 | 27.6 |
| | hardness* (mm) | 5.5 | 5.0 | 6.0 | 4.5 | 9.0 | 5.5 | 3.0 | 6.0 | 8.3 | 8.3 |
| Enclosure layer hardness (Shore D) | | 65 | 58 | 68 | 65 | 62 | 65 | — | — | — | — |
| Center ball diameter (mm) | | 36 | 36 | 36 | 37.8 | 33.1 | 35.8 | — | — | — | — |
| Cover outer layer hardness (Shore D) | | 53 | 53 | 53 | 53 | 53 | 46 | 53 | 53 | 62 | 53 |
| Cover inner layer hardness (Shore D) | | 62 | 62 | 62 | 62 | 62 | 62 | — | — | — | 62 |
| #W1 HS = 45 m/s | Spin (rpm) | 2850 | 2880 | 2820 | 2880 | 2790 | 2890 | 2970 | 2640 | 3010 | 3150 |
| | Carry (m) | 211.6 | 211.2 | 212.3 | 211.0 | 210.8 | 211.0 | 210.0 | 206.8 | 209.5 | 208.0 |
| | Total distance (m) | 225.4 | 225.2 | 226.2 | 225.1 | 224.9 | 225.0 | 223.8 | 220.1 | 223.5 | 222.2 |
| | Hitting feel | ⊙ | ⊙ | ⊙ | ⊙ | ⊙ | ⊙ | x | ⊙ | ○ | ○ |
| #W1 HS = 35 m/s | Spin (rpm) | 4220 | 4240 | 4150 | 4260 | 4180 | 4270 | 4350 | 4020 | 4450 | 4600 |
| | Carry (m) | 143.5 | 143.3 | 144.2 | 143.1 | 143.1 | 143.0 | 140.9 | 139.8 | 141.0 | 140.1 |
| | Total distance (m) | 155.6 | 155.2 | 156.1 | 154.9 | 155.1 | 155.0 | 152.7 | 151.7 | 152.8 | 152.0 |
| | Hitting feel | ⊙ | ⊙ | ⊙ | ⊙ | ⊙ | ⊙ | x | ⊙ | Δ | Δ |
| SW HS = 20 m/s | Spin (rpm) | 6010 | 6030 | 6000 | 6030 | 6000 | 6150 | 6010 | 5990 | 4580 | 6030 |

*Core hardness is a distortion (mm) of the core under a load of 100 kg.

It is evident from the results in Table 2 that wound golf balls within the scope of the present invention provided excellent spin performance, flight distance and hitting feel independent of head speeds. It is noteworthy that the spin rate is low upon wood shots, but high upon sand wedge shots. The ball exerts spin properties which can contribute to both an increased distance and approach control. In contrast, a wound golf ball having a large diameter center of a relatively high hardness without an enclosure layer (Comparative Example 1) gave hard hitting feel due to its high hardness, received an increased spin rate, and traveled a somewhat shorter distance especially at a low head speed. A wound golf ball having a large diameter center of a relatively low hardness (Comparative Example 2) was acknowledged to show suppressed spin and improved hitting feel although it traveled only a short distance due to the lack of restitution. A wound golf ball having a solid core of a conventional diameter and a cover (Comparative Example 3) received a high spin rate upon driver shots, with a resultant short distance, because of the thick thread rubber layer. Upon sand wedge shots, its spin rate was low, which means that the ball is not easy to control upon approach shots. A wound golf ball having a two-layer cover formed on the same core as Comparative Example 3 (Comparative Example 4) received appropriate spin upon sand wedge shots. Because of the thick thread rubber layer, however, it received excess spin upon driver shots, with a resultant short distance.

There has been described a wound golf ball which provides satisfactory spin, control and flight distance at any head speed from high to low head speed ranges. It is believed that a greater number of players will favorably use the ball regardless of their skill, that is, independent of their head speed.

Japanese Patent Application No. 106316/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising a center ball having thread rubber wound thereon and a cover enclosing the wound center ball, wherein said center ball consists of a center core having a diameter of up to 37 mm and experiencing a distortion of 3.5 to 10 mm under a constant load of 100 kg and a layer enclosing the center core and having a Shore D hardness of at least 55, said center ball having a diameter of 33 to 38 mm, and said cover consists of an inner layer having a Shore D hardness of 55 to 68 and an outer layer having a Shore D hardness of 30 to 58, the inner layer being harder than the outer layer by at least 5 in Shore D hardness.

2. The wound golf ball of claim 1 wherein said enclosure layer has a Shore D hardness of 55 to 68 and a gage of 0.5 to 5 mm.

* * * * *